US008640793B2

(12) United States Patent
Wentworth

(10) Patent No.: US 8,640,793 B2
(45) Date of Patent: Feb. 4, 2014

(54) DYNAMIC STEERING TOOL

(71) Applicant: Steven W. Wentworth, Fountain Hills, AZ (US)

(72) Inventor: Steven W. Wentworth, Fountain Hills, AZ (US)

(73) Assignee: Earth Tool Company, LLC, Oconomowoc, WI (US)

( * ) Notice: Subject to any disclaimer, the term of this patent is extended or adjusted under 35 U.S.C. 154(b) by 0 days.

(21) Appl. No.: 13/655,786

(22) Filed: Oct. 19, 2012

(65) Prior Publication Data

US 2013/0098686 A1 Apr. 25, 2013

Related U.S. Application Data

(60) Provisional application No. 61/548,753, filed on Oct. 19, 2011.

(51) Int. Cl.
*E21B 7/06* (2006.01)
*E21B 47/022* (2012.01)
*E21B 4/02* (2006.01)

(52) U.S. Cl.
USPC ..... 175/61; 175/26; 175/45; 175/73; 175/101; 175/107

(58) Field of Classification Search
USPC ..... 175/61, 45, 26, 107, 101, 73
See application file for complete search history.

(56) References Cited

U.S. PATENT DOCUMENTS 4,187,918 A * 2/1980 Clark ..... 175/39
4,909,337 A * 3/1990 Kochnev et al. ..... 175/107
6,092,610 A 7/2000 Kosmala et al.
6,109,372 A 8/2000 Dorel et al.
6,571,888 B2 * 6/2003 Comeau et al. ..... 175/61
7,086,486 B2 * 8/2006 Ravensbergen et al. ..... 175/107
7,610,970 B2 * 11/2009 Sihler et al. ..... 175/61
8,381,839 B2 * 2/2013 Rosenhauch ..... 175/95
2002/0066598 A1 * 6/2002 Rozendaal et al. ..... 175/53
2002/0166701 A1 * 11/2002 Comeau et al. ..... 175/61
2002/0175003 A1 * 11/2002 Pisoni et al. ..... 175/74
2003/0146022 A1 * 8/2003 Krueger ..... 175/61
2005/0236189 A1 * 10/2005 Rankin, III ..... 175/73
2006/0254824 A1 * 11/2006 Horst et al. ..... 175/61

(Continued)

FOREIGN PATENT DOCUMENTS

EP 1258593 A2 * 11/2002 ..... E21B 7/06

OTHER PUBLICATIONS

Drilling Contractor, "Rotary steerable drilling: faster, smoother wellbores", article, Nov./Dec. 2002, p. 30-31.

(Continued)

*Primary Examiner* — Jennifer H Gay
(74) *Attorney, Agent, or Firm* — Tomlinson Rust McKinstry Grable

(57) ABSTRACT

A dynamic steering tool for use with a horizontal directional drilling machine. The tool comprises and inner member, an outer member, a steering member, a drill stem, and a drill bit. The drill stem extends from within a borehole to the surface while the outer member only extends the length of the inner member within the borehole. The outer member is powered via the use of a progressive cavity motor. In operation, the drill stem, inner member, and drill bit rotate in a clockwise position while the outer member rotates in a counterclockwise direction. Rotating the outer member opposite the inner member allows the outer member to remain stationary and cause the tool to steer while the inner member continues to rotate.

27 Claims, 7 Drawing Sheets

(56) References Cited

U.S. PATENT DOCUMENTS

| | | | | |
|---|---|---|---|---|
| 2007/0137897 | A1* | 6/2007 | Sanders et al. | 175/61 |
| 2007/0235227 | A1* | 10/2007 | Kirkhope et al. | 175/73 |
| 2008/0217062 | A1* | 9/2008 | Southard | 175/57 |
| 2009/0308659 | A1* | 12/2009 | Crowley et al. | 175/61 |
| 2010/0270079 | A1* | 10/2010 | Southard | 175/61 |
| 2011/0162891 | A1* | 7/2011 | Camp | 175/61 |
| 2012/0018218 | A1* | 1/2012 | Rosenhauch | 175/24 |
| 2012/0031676 | A1* | 2/2012 | Comeau et al. | 175/61 |
| 2012/0080234 | A1* | 4/2012 | Hall et al. | 175/61 |
| 2013/0098686 | A1* | 4/2013 | Wentworth | 175/45 |

OTHER PUBLICATIONS

Drilling Contractor, "Range of hole sizes, internal steering features of Schlumberger RSS", article, Mar./Apr. 2001, p. 38-39.

* cited by examiner

DYNAMIC STEERING TOOL

CROSS REFERENCE TO RELATED APPLICATION

This application claims the benefit of provisional patent application Ser. No. 61/548,753 filed on Oct. 19, 2011, the entire contents of which are incorporated herein by reference.

FIELD OF THE INVENTION

The present invention relates generally to the field of horizontal directional drilling and specifically horizontal rock drilling.

BACKGROUND OF THE INVENTION

Horizontal directional drilling is a type of underground horizontal directional drilling. Horizontal directional drills that are capable of drilling through rock are configured to drill through dirt and many different rocky terrains while simultaneously being steered. Horizontal rock drilling may use a tri cone bit configuration. The bit is steered by adding asymmetry to the bit relative to the adjacent bore walls. The asymmetry is typically achieved by is incorporating some form of a deflection device or steering member some distance behind the bit, such as a deflection shoe or a bend in the casing that inherently comprises a deflection shoe. The orientation of the deflection device or steering member is preferably kept stable about the bore axis during the steering operation.

Progressive cavity motors, also known as mud motors, incorporate the bend feature and have been used to steer the drill bit. The motors couple the outer casing of the drill string and integrate the bend into the outer casing. The motors are actuated by a very high flow of drilling fluid or mud through the motor. Mud flow rotates the motor shaft and works to turn the bit without rotation of the drill string. By maintaining a stationary position of the bend about the bore axis while continuing to drill, deviation is accumulated and the process of directional drilling is achieved. High mud flow rates are required to use these motors which can sometimes be undesirable.

Rotary steering tools may also be used to steer the bit. The rotary steering tool incorporates the bend concept and couples the tricone bit directly to the drill stem, such that the bit is actuated by rotation of the drill stem. The bend is then preferably coupled to something to prevent its rotation about the bore axis. The bore wall is typically used as the stabilizer. However, if the friction between the bore wall and the bend is too much or too little, the use of the steering tool may be inefficient.

A third method utilizes a dual drill pipe system that has the steering bend coupled to the outer pipe and the tricone bit is rotated via the inner pipe which is concentric to the outer pipe. The outer pipe of the dual drill pipe system is not rotated during a steering deviation.

The present invention provides the ability to keep the drill stem rotating during the steering process and keep a bend position about the bore axis without utilizing the compressive and shear strength of the bore wall. The present invention also uses less fluid to operate the motor than typical progressive cavity motors.

DESCRIPTION OF THE PREFERRED EMBODIMENT

The disclosed invention works to eliminate the need for high mud flow and make long boreholes possible given the dynamic friction produced by rotating an inner member and drill bit continuously while boring. The disclosed invention also eliminates the need for a dual drill pipe system extending all the way to the surface because the positioning of the outer pipe can be controlled downhole rather than having to be controlled at the surface. The present invention provides the ability to keep the drill stem rotating during the steering process and keep a bend position about the bore axis without utilizing the compressive and shear strength of the bore wall. The dynamic steering tool is configured to work in materials as soft as silt, as hard and stable as granite, or as unstable as washed river rock as it does not depend on formation properties for steering. It should be appreciated that the present invention not only has application in typical horizontal directional drilling operations, but also has application in of and gas drilling. At times during oil and gas drilling operations, it may be necessary to simultaneously steer while drilling vertically or horizontally through rock.

Figure 1:
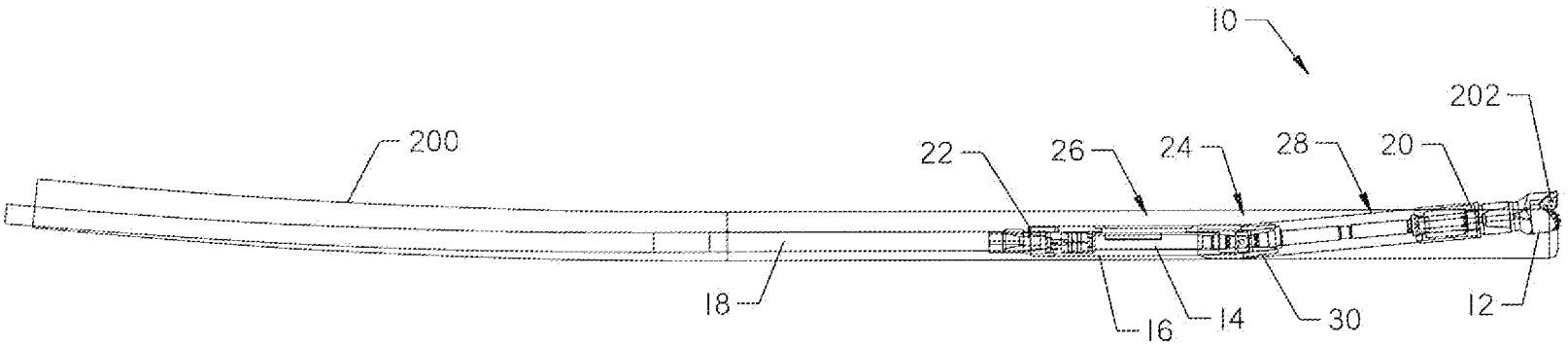
FIG. 1 is a side view of a portion of a bore hole occupied by the dynamic steering tool of the present invention.

Turning to the Figures, and first to FIG. 1, shown therein is a dynamic steering tool 10 within a borehole 200. The tool 10 comprises a drill bit 12, an inner member 14, an outer member 16, and a drill stem 18. As used herein, the terms "drill stem" and "drill string" are used interchangeably. The inner member 14 is disposed within the outer member 16. A fast end of the inner member 20 connects to the drill bit 12 and a second end of the inner member 22 connects to the drill stem 18. The outer member 16 only encloses the length of the inner member 14. The drill stem 18 is a hollow single pipe. The single pipe drill stem 18 extends from downhole to a rig on the ground surface (not shown). Rotation of the drill stem 18 is powered via hydraulic oil supplied to the drill rig spindle motor at the ground surface. In operation, the rig at the ground surface rotates the drill stem 18 in a clockwise direction which in turn rotates the inner member 14 and the drill bit 12 in a clockwise direction.

The outer member 16 is capable of rotating in a counterclockwise direction opposite the rotation of the inner member 14 via the use of fluid power. Fluid flows from the surface through the drill stem 18 and to the tool 10 in the borehole 200 to power rotation of the outer member 16. The inner member 14 and the outer member 16 are capable of rotating individually or simultaneously and in opposite directions. If the outer member 16 and the inner member 14 rotate simultaneously at the same speed and in opposite directions, the net speed of the outer member will be equal to zero; as a result, the outer member 16 will stay in place and function to steer the tool 10 in a desired direction. This gives the tool 10 the ability to steer while simultaneously rotating the drill stem 18 which decreases the amount of friction created between the tool 10 and the borehole 200 during drilling operations. The less friction created in the borehole 200 allows the tool 10 to use less fluid and drill farther.

Continuing with FIG. 1, the outer member 16 comprises a steering member 24, a control section 26, and a progressive cavity motor 28. The steering member 24 controls the direction the tool will drill during operation. The control section 26 regulates the amount of fluid allowed to pass from the drill stem 18 into the tool 10, and the progressive cavity motor 28 powers rotation of the outer member 16.

The steering member 24 or deflection device used with the tool 10 is a bend area 30 in the outer member 16. It should be appreciated by those of skill in the art that other forms of steering members or deflection devices may be possible for use with the current invention as long as the steering member functions to deflect the apparatus in the desired direction of steering. The tool 10 can be steered in different directions based upon the position of the bend area 30 of the steering member 24 within the borehole 200 when the bend area 30 remains stationary. The direction the bend area 30 projects the tool 10 will control the direction the tool 10 will steer, if the bend area 30 is projecting the tool 10 upwards, the tool will steer upwards while drilling the borehole 200. It should be noted that the angle of the bend area 30 of the steering member 24 in FIG. 1 is exaggerated for clarity which results in the drill bit 12 extending out of the borehole 200.

Figure 2:
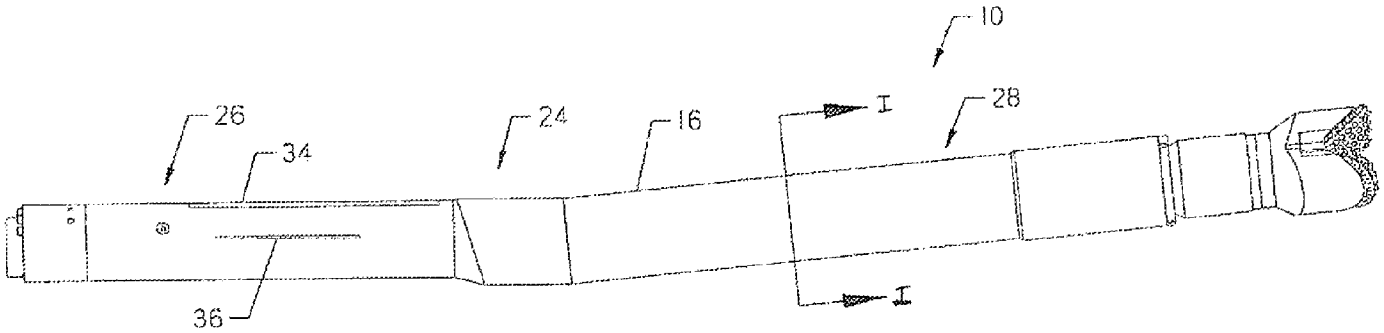
FIG. 2 is a side view of the tool shown in FIG. 1.
Figure 3:
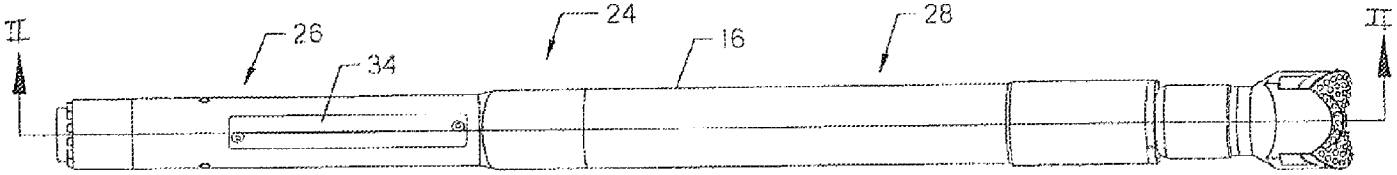
FIG. 3 is a top view of the tool of FIG. 2.

Turning now to FIGS. 2 and 3, shown therein is a side view of the outer member 16 of the tool 10. The control section 26 of the outer member 16 houses an orientation sensor 32 (shown in FIG. 4). The orientation sensor 32 is contained within the control section 26 of the outer member 16 below an orientation sensor cover 34. The orientation sensor 32 is used to help monitor the location and orientation of the tool 10. Signals generated by the orientation sensor 32 may pass through the orientation sensor cover 34 or through a plurality of transmission windows 36 formed on the sides of the outer member 16. The signals are transmitted to a receiver (not shown) located at the ground service for use by an operator (not shown). The orientation sensor 32 is shown in the figures in the control section 26 of the tool 10; however, it will be appreciated by those of skill in the art that the orientation sensor may be positioned in different locations on the tool 10. FIGS. 2 and 3 also show the steering member 24 and progressive cavity motor 28 of the outer member 16.

Figure 4:
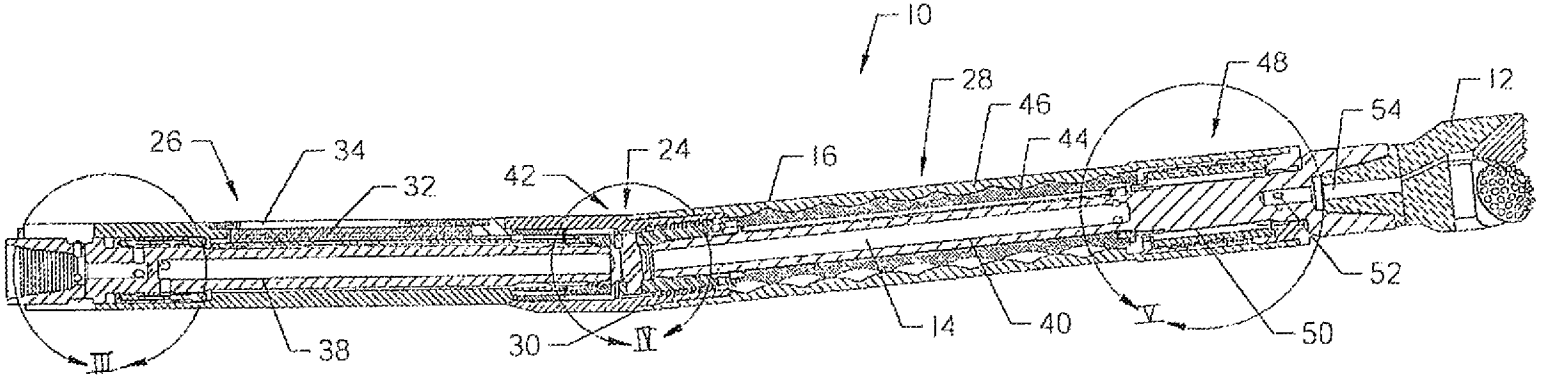
FIG. 4 is a vertical plane section II-II through the center of the tool of FIG. 3.

FIG. 4 shows a vertical plane section II-II through the center of the tool 10 of FIG. 3. The inner member 14 shown in FIG. 4 comprises a rearward shaft 38 and a forward shaft 40. The rearward shaft 38 and the forward shaft 40 connect together at a universal joint 42. The rearward shaft 38 and the forward shaft 40 connect together at an angle causing a bend in the inner member 14. The steering member 24 of the outer member 16 surrounds the universal joint 42 creating the bend area 30 in the steering member. The forward shaft 40 connects to the drill bit 12 and the rearward shaft 38 connects to the drill stem 18 (FIG. 1). These connections may be made via threaded connections, but other forms of connection are also possible.

The progressive cavity motor 28 of the outer member 16 shown in FIG. 4, comprises a rotor 44 and a stator 46. The rotor 44 and the stator 46 operate to rotate the outer member 16 in a counterclockwise direction. The control section 26, shown in FIG. 4, works to regulate the passage of the fluid flowing through the drill stem 18, into the tool 10, and towards the rotor 44 and stator 46. Also shown in FIG. 4 is a bearing set 48. The bearing set 48 reacts fore and aft thrust should the tool 10 become hung up on an unstable formation. Additionally the bearing set 48 supports the forward shaft 40 within the progressive cavity motor 28. The bearing set 48 also comprises a plurality of longitudinal ports 50. Proximate the longitudinal ports 50 are a plurality of radial ports 52 and a bit feed passage 54. Fluid exiting the progressive cavity motor 28 flows through the longitudinal ports 50 where it is directed into the radial ports 52. Upon entering the radial ports 52, fluid will flow through the bit feed passage 54 and exit through the drill bit 12.

Figure 5:
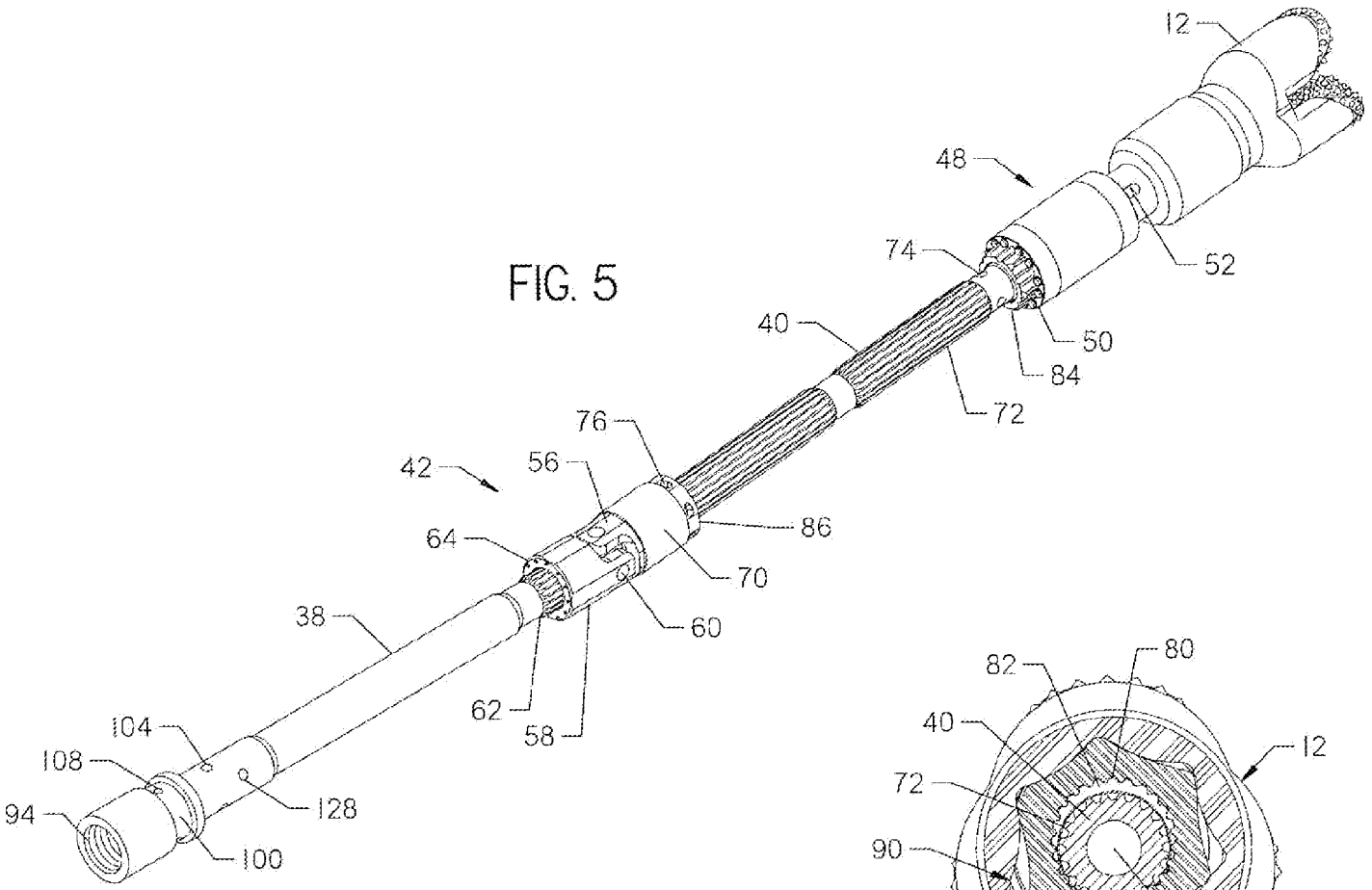
FIG. 5 is an isometric view of the tool with outer components removed.
Figure 8:
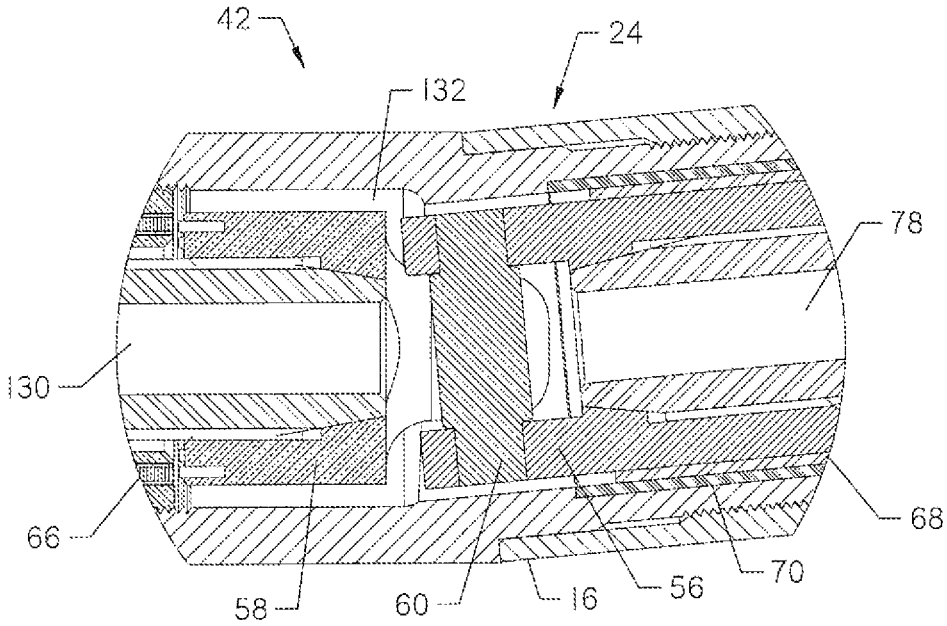
FIG. 8 is detail view IV from FIG. 4.

Turning now to FIG. 5, an isometric view of the tool 10 with the outer member 16 (FIG. 4) removed is shown. The universal joint 42, which connects the forward shaft 40 to the rearward shaft 38 is shown more clearly. The universal joint 42 comprises a front yoke 56 and a rear yoke 58. The front yoke 56 and rear yoke 58 are configured to fit together and connect via a plurality of cross-shafts 60 (also shown in FIG. 8). A plurality of splines 62 are located at the forward end of the rearward shaft 38 and are used to mount the rear yoke 58. Also located on the rear yoke 58 are a series of rare earth magnets 64 and coils 66 (FIG. 8). The series of rare earth magnets 64 will interact with the coils 66 (FIG. 8) of the control section 26 to produce electrical power to operate the electronics and control the rate of fluid flow through the tool 10. A sleeve 68 (FIG. 8) and a bearing sleeve 70 are also contained within the universal joint 42. The bearing sleeve 70 acts as a rear radial bearing for forward shaft 40 and is preferably constructed of sintered tungsten carbide per the process known as ConformaClad and is water resistant.

It will be appreciated that all components shown within FIG. 5 rotate with the inner member 14 of the drill stem 18, and the drill bit 12 shown in FIG. 1. Components not shown in FIG. 5 either rotate with the outer member 16, or in the case of the rotor 44, orbit between the inner member 14 and the outer member 16.

Continuing with FIG. 5, external splines 72 located on the length of the forward shaft 40 are shown. Also on the forward shaft 40 are a plurality of forward shaft ports 74. The front yoke 56, shown in FIG. 5 similarly contains a plurality of front yoke ports 76. Fluid will pass from the rearward shaft 38 through the universal joint 42 and into the forward shaft 40. The forward shaft 40 has a central passage 78 (FIG. 8). When fluid enters the forward shaft 40 it will flow through the central passage 78 and exit out the forward shaft ports 74 where the fluid will interact with the external splines 72 on the forward shaft 40.

Figure 6:
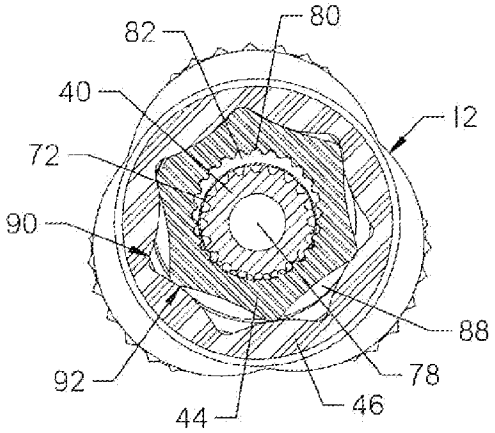
FIG. 6 is a section view I-I of FIG. 2.

The external splines 72 on the forward shaft 40 are seen more clearly in FIG. 6. The rotor 44 similarly has internal splines 80 shown in FIG. 6. The external splines 72 on the forward shaft 40 and the internal splines 80 on the rotor 44 together create a spline void 82. Once fluid exits the forward shaft ports 74 it will flow into spline void 82.

With reference again to FIG. 5, the bearing set 48 has a plurality of sealing surfaces 84. Similarly, the surface 86 of the front yoke 56 acts as a sealing surface. Once fluid flows out of the forward shaft ports 74 it is trapped within the spline void 82 due to the sealing surfaces 84 and the surface 86 of the front yoke 56. The only option is for fluid to flow rearward into the front yoke ports 76. Fluid will then flow from the front yoke ports 76 into the progressive cavity motor 28. Also shown in FIG. 5 are the openings to the longitudinal ports 50 and the radial ports 52.

Continuing with FIG. 6, shown therein is section I-I through the progressive cavity motor 28 of the tool 10 per the location as shown in FIG. 2. The configuration of the rotor 44 and the stator 46 forms a hydraulic cavity 88 for fluid to enter the motor 28 once fluid exits the front yoke ports 76. The hydraulic cavity 88 is created between the rotor 44 and the stator 46 because the stator has an internal seven (7) lobe feature 90 that describes an outer surface of the hydraulic cavity 88 and the rotor 44 has an external six (6) lobe feature 92 that describes an inner surface of the hydraulic cavity 88. The lobe features 90 and 92 arc configured such that they form a helix running lengthwise through the inside of the stator 46 and the outside of the rotor 44. A design of a lessor rotor/stator lobe count is also possible without losing function. The direction of the helix formed by the lobe features 90 and 92 produces counterclockwise or negative direction of rotation of the stator 46 about the forward shaft 40.

As seen in FIG. 6, the external splines 72 on the forward shaft 40 engage the internal splines 80 of the rotor 44. The passage of fluid between the rotor 44 and the stator 46 will cause the rotor to start to orbit in a counterclockwise direction. The orbiting of the rotor 44 causes the lobe features 90 and 92 to engage to further rotate the rotor 44 within its orbit. The interaction of the lobe features 90 and 92 will also cause the stator 46 to rotate and in turn rotate the outer member 16. Rotation of the rotor 44 about its orbit will also cause interaction of splines 72 and 80 between the forward shaft 40 and the rotor 44. Also shown in FIG. 6 is the central passage 78 which runs through the center of the forward shaft 40.

FIG. 6 is viewed facing forward towards the drill bit 12. The drill bit is shown extending beyond the outside diameter of the stator 46. This is relevant to achieve steering, the bit 12 must cut a bore that allows the angled dynamic steering tool 10 to lie within the bore volume and redirect the bit per the angle of the bend formed in the steering member as defined by FIG. 2.

Figure 7:
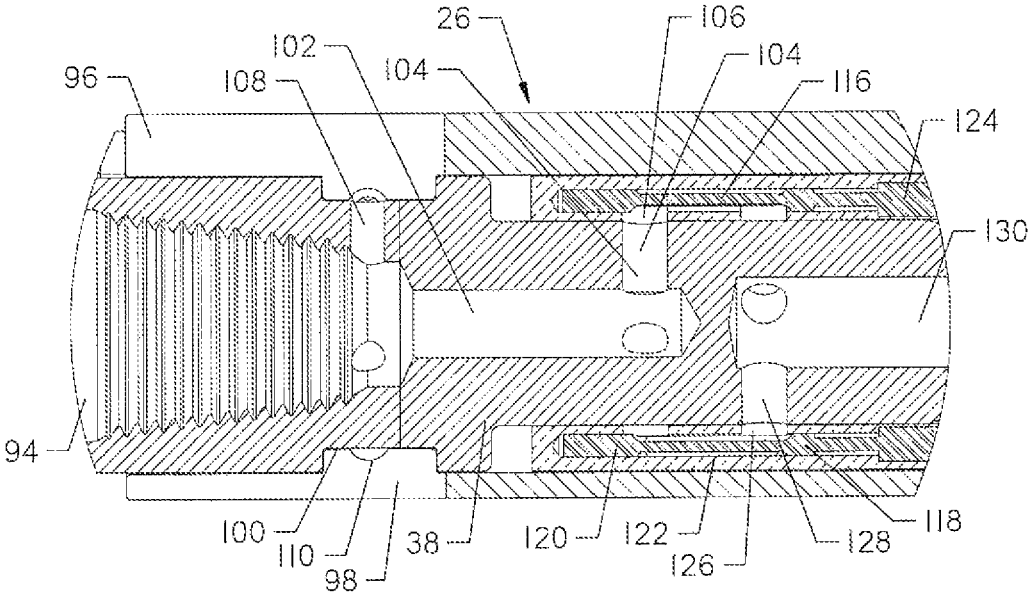
FIG. 7 is detail view III from FIG. 4.

Turning now to FIG. 7, shown therein is a detail III of FIG. 4. FIG. 7 shows the vertical section of the rear end of the control section 26 of the outer member 16 in greater detail. Rearward shaft 38 has a threaded end 94 (also shown in FIG. 5) located within a tailpiece 96. The tailpiece 96 fits onto the threaded end 94 of the rearward shaft 38 via a trapping land 98 that fits into a rearward groove 100 (also shown in FIG. 5) located on the rearward shaft. The trapping land 98 serves to locate the rearward shaft 38 both axially and radially and provides a plain bearing surface wetted with fluid.

The rearward shaft 38 also contains an axial hole 102 as shown in FIG. 7. The axial hole 102 leads to a rearward shaft port 104 (also shown in FIG. 5) which leads to an annular groove 106. The annular groove 106 leads to a series of spools 116 in the control section 26 used to control the rate of fluid through the tool 10. The series of spools 116 are made up of a forward land 118, a rearward land 120, a longitudinal flow groove 122, and a spool motor 124. The spool motor 124 is used to adjust the position of the spools 116. The rate of flow of fluid into the tool 10 is controlled via adjusting the position of the spools 116. Fluid will pass from the axial hole 102, into the rearward shaft port 104, into the annular groove 106, and then into the series of spools 116. Fluid will then pass through the longitudinal flow groove 122 of the spools 116 formed between the forward and rearward land 118 and 120.

The control section 26 further comprises an annular discharge groove 126, a second radial port 128 (also shown in FIG. 5), and an axial bore 130. After fluid passes all the way through the longitudinal flow groove 122 of the spools 116, the fluid will pass into the annular discharge groove 126. From the annular discharge groove 126, fluid will flow into the second radial port 128 and into the axial bore 130. Once in the axial bore 130, fluid will flow into the steering member 24 shown in FIG. 8.

Figure 10:
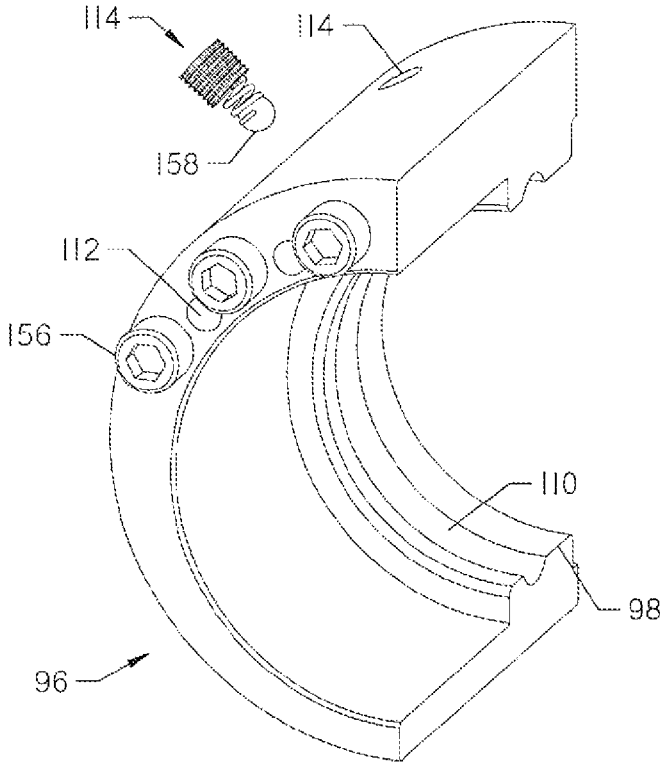
FIG. 10 is a hidden line diametric view of a left tailpiece sub assembly removed from the tool.

The rearward shaft 38 also contains a plurality of alternate rearward shaft ports 108 (also shown in FIG. 5). The tailpiece 96 connected to the rearward shaft 38 further comprises a tailpiece annular groove 110, a plurality of rearward facing ports 112, and series of pressure relief valves 114 (FIG. 10). If there is a large amount of fluid entering the rearward shaft 38, the excess fluid will pass through the alternate rearward shaft ports 108 and into the tailpiece annular groove 110. From there, fluid will pass through the pressure relief valves 114 and exit the tool 10 through one of the plurality of rearward facing ports 112 (FIG. 10).

FIG. 8 is detail IV of the section view of FIG. 4 showing the universal joint 42 and the steering member 24. The universal joint 42 of the steering member 24 comprises an internal area 132. Fluid that flows from the axial bore 130 of the rearward shaft 38 will pass through the rear yoke 58 and fill the internal area 132. Fluid will then pass into the front yoke 56 where it will continue into the central passage 78 of the forward shaft 40. Also shown in FIG. 8 are the sleeve 68 and the bearing sleeve 70. The front yoke 56 carries the bearing sleeve 70 that rotates against the sleeve 68 in the steering member 24.

Figure 9:
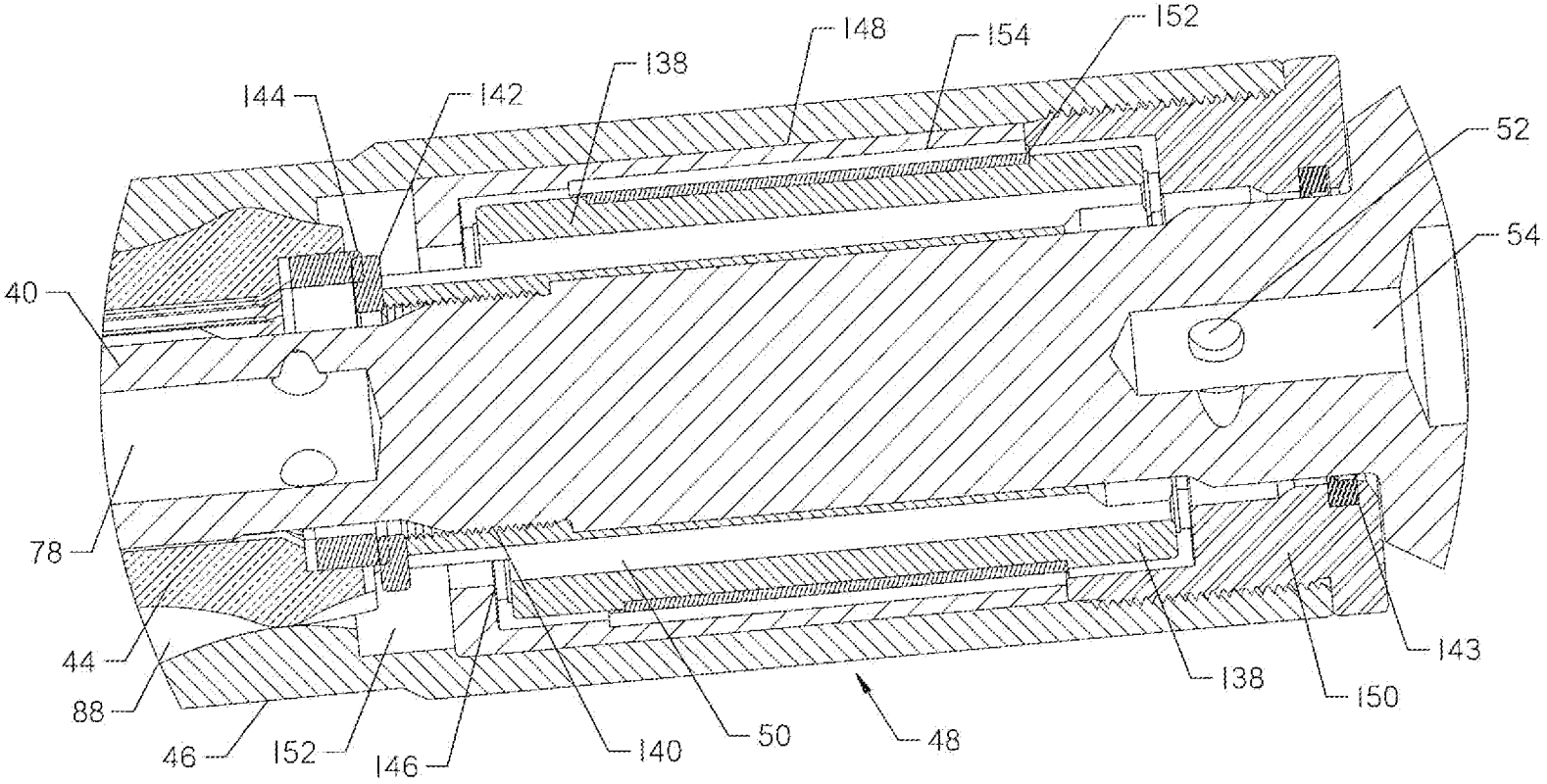
FIG. 9 is detail view V from FIG. 4.

FIG. 9 is detail V of vertical cross section FIG. 4. FIG. 9 further defines the area about the bearing set 48. The bearing set 48 is comprised of a bearing body 138 that mounts to forward shaft 40 via a thread set 140. The bearing set 48 further comprises a floating face seal 142, a face gland 144, a plurality of ceramic buttons 146, a flanged sleeve 148, and a housing nut 150. Fluid discharged from the hydraulic cavity 88 between the rotor 44 and the stator 46 is discharged into a discharge area 152. Fluid then passes from the discharge area 152 into the longitudinal ports 50.

FIG. 9 is detail "E" of vertical cross section FIG. 4, FIG. 9 further defines the area about the bearing set 48. The bearing set 48 is comprised of a bearing body 138 that mounts to forward shaft 40 via a thread set 140. The bearing set 48 further comprises a floating face seal 142, a face gland 144, a plurality of ceramic buttons 146, a flanged sleeve 148, and a housing nut 150. Fluid discharged from the hydraulic cavity 88 between the rotor 44 and the stator 46 is discharged into a discharge area 152. Fluid then passes from the discharge area 152 into the longitudinal ports 50.

The floating face seal 142 bears against the rear face of the bearing body 138 and against the face gland 144 placed at a front side of the rotor 44. As the rotor 44 orbits, the floating face seal 142 will provide a seal between the pressurized fluid in the central passage 78 and the discharge area 152 beyond the progressive cavity motor 28. The plurality of ceramic buttons 146 bear against the flanged sleeve 148 if the bearing set 48 is thrust rearward. The plurality of ceramic buttons 146 will bear against the housing nut 150 if the bearing set 48 is thrust forward. The flanged sleeve 148 comprises a bearing surface 154. The bearing surface 154 of the flanged sleeve 148 provides a sliding reaction surface for ceramic buttons 146. The floating face seal 142 ensures all fluid beyond the progressive cavity motor 28 flows through radial ports 52 and into a bit feed passage 54 for final discharge from the bit 12. Additional seals 143 are located near the bit to ensure a tight seal between the outer member 16 and the forward shaft 40 near the drill bit 12.

FIG. 10 is the tailpiece 96 removed from the dynamic steering tool 10 (FIG. 5) to demonstrate the assembly means. The tailpiece 96 is made of two halves. The trapping land 98 can be slipped into the rearward groove 100 of the rearward shaft 38 (as shown in FIG. 5) before it is secured by a plurality of bolts 156 to the control section 26 of the outer member 16. The rearward groove 100, described with reference to FIG. 7, communicates with the pressure relief valves 114 through the alternate rearward shaft ports 108. The pressure relief valves 114 comprise a spring loaded ball 158. When an overpressure is produced by excess available fluid, the spring loaded ball 158 lifts from the alternate rearward shaft port 108 and the excess fluid is discharged through the rearward facing ports 112 in the tailpiece 96. Pressure relief valve 114 is shown out of position in FIG. 10 to enhance clarity.

In operation, pressurized fluid flows from the drill rig through the hollow single member drill stem 18 that is rotating clockwise preferably at 150 RPM and being thrust forward with approximately 10,000 pounds of force. As a result of the rotation and the thrusting forward of the drill stem 18, the drill bit 12 is rotated clockwise and thrust forward into a front face 202 of the borehole 200 (FIG. 1).

The rotational speed of the inner member 14 is controlled by the amount of hydraulic oil supplied to the drill rig spindle motor at the ground surface (not shown) along with possibly several gear range choices. Typically the inner member 14 speed is monitored in an effort to maximize productivity, however no extraordinary measures are undertaken to attain or maintain an exact speed, plus or minus 5% of the target speed might be deemed acceptable in most horizontal directional drilling applications.

The rotational speed of the outer member 16 is a function of the fluid flow rate through the progressive cavity motor 28, and to a lesser extent, the torque required to turn the steering member 24 of the outer member 16. The greater the amount of fluid allowed into the motor 28, the faster the outer member 16 will rotate. Accelerating or decelerating the rotation of the outer member 16 allows the operator to change the clock position of the bend area 30 of the steering member 24 of the outer member 16. The opportunity exists to closely control either the inner member 14 speed, fluid flow rate through the progressive cavity motor 28, or both in unison, to achieve the desired clock position of the steering member 24.

Figure 11:
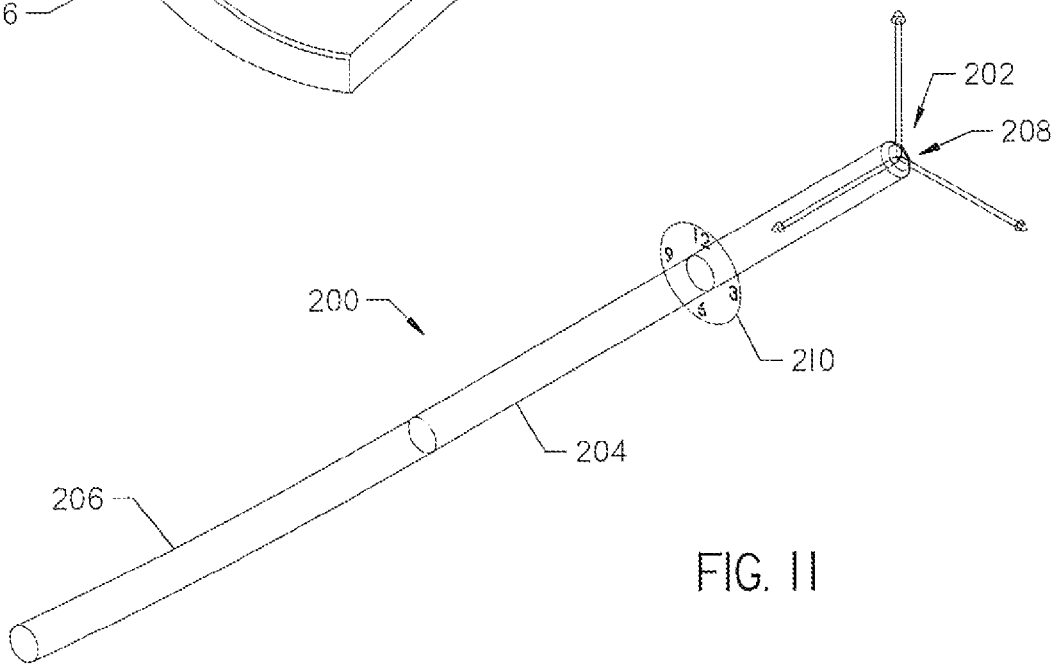
FIG. 11 is an isometric see through view of a bore hole with a local coordinate system.

The orientation of the tool 10 within the borehole 200 can be described using a local coordinate system as shown in FIG. 11. The hollow borehole 200, shown in FIG. 11 comprises front face 202, a straight section 204, and a descending actuate section 206. A Cartesian coordinate system 208 is aligned with the front face 202 and has its Z-axis concentric with the straight bore section 204. The Y-axis is in the vertical gravitational plane (pointed upwards) and the X-axis lies in the horizontal gravitational plane. This coordinate system follows the right hand rule of Cartesian coordinates and is valid for all orientations of straight bore section 204 other than perfectly vertical. A clock 210 is also shown with reference to the straight section 204 of the borehole 200. The clock 210 is a means of identifying roll of the tool 10 about a Z-axis. The 12 o'clock position of the clock 210 always lies in the Y-Z plane. Drilling progress is defined as being negative about the Z-axis. Rotation is defined with respect to the clock 210 centered on the Z-axis as viewed from the positive Z-position. Therefore, positive rotation about the Z-axis is in the clockwise direction. The coordinate system is dynamic and moves with the drill bit 12 as front face 202 of the borehole 200 progresses.

Continuing with the operation of the tool 10, as the drill stem 18 is rotating in the clockwise direction approximately about the Z-axis, the steering member 24 must be held stationary from rotating about the Z-axis. As discussed above, this is accomplished by rotating the outer member 16 in the counterclockwise direction about the inner member 14 which rotates the steering member 24 in the reverse direction that the drill stem 18 is being rotated. To keep the steering member 24 stationary, the steering member 24 is preferably rotated at the same speed as the drill stem 18 is being rotated. If the inner member 14 speed is 150 RPM relative to the ground and the outer member 16 is −150 RPM (negative or in the opposite direction) relative to the inner member, the resulting speed of the outer member 16 with respect to the ground is zero. This is the preferred condition to achieve having the bend area 30 of the steering member 24 held stationary. Holding the bend area 30 stationary and in the desired clock position allows the bend to angle the tool 10 in the desired direction of steering which causes the bit 12 to drill in that direction.

To drill a straight borehole, the outer member 16 will not rotate counterclockwise at the same speed as the inner member 14 because this causes the outer member 16 to stay in place and causes steering. The outer member 16 will instead rotate at a slightly slower speed causing the outer member 16 to rotate all the way around because its net speed will not equal zero. Allowing the outer member 16 to rotate all the way around allows the bend area 30 of the steering member 24 to project the tool 10 evenly throughout the entire circumference of the borehole 200 during drilling; this takes away any steering the bend area 30 might inflict on the tool 10.

During steering operations, the orientation sensor 32 reads the clock position of the control section 26 and therefore the steering member 24. The orientation sensor 32 then compares the clock position of the steering member 24 to a target clock position provided by the operator and transmits this information to the orientation sensor 32 from the surface via a RF signal. Using propriety custom written software algorithms executed by a processor within the orientation sensor 32, the software determines if the outer member 16 of the tool 10 must be accelerated or decelerated while rotating in a counterclockwise direction at approximately 150 RPM about the inner member 14 to achieve the target clock position in order to steer the tool 10 in the desired direction. The result of this calculation is transmitted in the form of power to the spool motors 142 within the control section 26 of the outer member 16.

To achieve the desired clock position, fluid passes from the drill stem 18 to the axial hole 102 of the rearward shaft 38. The spools 116 within the control section 26 are adjusted to restrict or increase the amount of fluid required by the motor 28 to position the bend area 30. Fluid then passes through the axial hole 102 of the rearward shaft 38 and floods the internal area 132 of the universal joint 42 within the steering member 24. Fluid then continues under pressure to the central passage 78 of the forward shaft 40 until it is discharged through the forward shaft ports 74. Fluid then flows rearwards through the spline void 82 until it is discharged through the front yoke ports 76 and enters the motor 28 of the dynamic steering tool 10, or the hydraulic cavity 88 between the rotor 44 and the stator 46. The metered fluid flow accelerates or decelerates the orbiting of rotor 44 about forward shaft 40 resulting in accelerated or decelerated rotation of stator 46 in the counterclockwise direction.

Fluid then continues forward within the hydraulic cavity 88, continually losing pressure by performing hydraulic motor work until it is discharged into the discharge area 152. The fluid then continues to flow through the longitudinal ports 50 within the bearing set 48 and into the radial ports 52. From the radial ports, fluid will flow into the bit feed passage 54 and be discharged through the bit 12. Fluid discharged through the bit is used to cool the bit and float the spoil produced by the bits rolling element cutters rearward about the outside of the tool 10 and along the drill stem 18 within the borehole 200 until it reaches the surface.

Although the present invention has been described with respect to the preferred embodiment, various changes and modifications may be suggested to one skilled in the art, and it is intended that the present invention encompass such changes and modifications as fall within the scope of this disclosure.

What is claimed is:

1. A dynamic steering tool for use with a horizontal directional drilling machine comprising a drill stem and a drill bit, the tool comprising:

an outer member for providing directional control comprising:

a steering member: and a progressive cavity motor comprising a rotor and a stator, wherein the passage of fluid through a cavity formed between the rotor and the stator rotates the outer member and the steering member in a counterclockwise direction;

an inner member disposed within the outer member for rotating the drill bit in a clockwise direction connected at a first end to the drill bit and at a second end to the drill stem; and an orientation sensor to determine an orientation of the steering member.

2. The dynamic steering tool of claim 1 wherein the outer member further comprises a control section comprising a spool, wherein adjusting the position of the spool permits or restricts the flow of fluid through the outer member.

3. The dynamic steering tool of claim 1 wherein the drill bit is a tricone bit.

4. The dynamic steering tool of claim 1 wherein the inner member comprises a forward shaft and a rearward shaft connected via a universal joint proximate the steering member.

5. The dynamic steering tool of claim 4 wherein the steering member surrounds the universal joint.

6. The dynamic steering tool of claim 4 wherein the drill bit is connected to the forward shaft and the drill stem is connected to the rearward shaft.

7. The dynamic steering tool of claim 1 wherein the second end of the inner member is connected to the drill stem via a threaded connection.

8. The dynamic steering tool of claim 1 further comprising a bearing proximate the drill bit.

9. The dynamic steering tool of claim 1 further comprising pressure relief valves to allow fluid to exit the dynamic steering tool.

10. The dynamic steering tool of claim 1 further comprising fluid flow control valves.

11. The dynamic steering tool of claim 1 further comprising radial ports.

12. A dynamic steering tool for use with a drilling machine the tool operatively connectable to a downhole end of a drill string, the tool comprising:

an inner member for rotating a drill bit in a clockwise direction connected to the drill string;

an outer member for providing directional control comprising:

a steering member; and a progressive cavity motor comprising a rotor and a stator supported within the outer member, wherein the passage of fluid through a cavity formed between the rotor and the stator rotates the outer member and the steering member in a counterclockwise direction.

13. The dynamic steering tool of claim 12 wherein the outer member further comprises a control section comprising a spool, wherein adjusting the position of the spool permits or restricts the flow of fluid through the outer member.

14. The dynamic steering tool of claim 12 wherein the inner member comprises a rotating shaft and a drill stem, wherein the rotating shaft connects at a first end to the drill bit and connects at a second end to the drill stem, wherein the drill stem extends to the surface.

15. The dynamic steering tool of claim 12 further comprising an orientation sensor to determine an orientation of the steering member.

16. The dynamic steering tool of claim 12 wherein the drill bit is a tricone bit.

17. The dynamic steering tool of claim 12 further comprising a bearing set proximate the drill bit to provide fore and aft thrust of the dynamic steering tool.

18. The dynamic steering tool of claim 12 further comprising a central passage for the passage of fluid through the dynamic steering tool.

19. The dynamic steering tool of claim 12 further comprising pressure relief valves to allow fluid exit the dynamic steering tool.

20. The dynamic steering tool of claim 12 further comprising fluid flow control valves.

21. The dynamistic steering tool of claim 12 further comprising radial ports.

22. A method for steering a drill bit for use with a horizontal directional drilling machine, the method comprising:

rotating a drill string in a first direction to rotate an inner member and the drill bit in the first direction, wherein the inner member is disposed within an outer member and connected to both the drill string and the drill bit;

rotating the outer member comprising a steering member in a second direction opposite the first direction, wherein rotation of the outer member relative to the inner member results in the rotational speed of the steering member with respect to the ground to equal approximately zero; and using an orientation sensor to determine an orientation of the steering member in a borehole.

23. The method of claim 22 further comprising the step of comparing the orientation of the steering member in the borehole to a targeted orientation of the steering member.

24. The method of claim 22 further comprising the step of repositioning a spool within the outer member as needed to increase or decrease a flow of fluid through the outer member to alter the position of the steering member as needed to steer the drill bit.

25. The method of claim 22 further comprising the step of using hydraulic oil supplied to a drill rig spindle motor at the surface to control the rotation of the inner member.

26. The method of claim 22 further comprising the step of casing a Cartesian coordinate system to determine the orientation of the steering member.

27. The method of claim 22 wherein the rotational speed of the steering member with respect to the ground is equal to zero.

* * * * *

UNITED STATES PATENT AND TRADEMARK OFFICE

CERTIFICATE OF CORRECTION

PATENT NO. : 8,640,793 B2
APPLICATION NO. : 13/655786
DATED : February 4, 2014
INVENTOR(S) : Wentworth It is certified that error appears in the above-identified patent and that said Letters Patent is hereby corrected as shown below:

In the Specification

Column 1, line 25, delete the second occurrence of the word “is”.

Column 2, line 10, delete “,” after the number 4 and substitute therefore --.--.

Column 2, line 35, delete “of” and substitute therefore --oil--.

Column 5, line 6, delete “arc” and substitute therefore --are--.

Column 6, delete lines 30 through 39.

Signed and Sealed this
Twenty-second Day of April, 2014

Michelle K. Lee

Michelle K. Lee
*Deputy Director of the United States Patent and Trademark Office*